US008673084B1

(12) United States Patent
McAlister

(10) Patent No.: US 8,673,084 B1
(45) Date of Patent: Mar. 18, 2014

(54) METHODS FOR VARNISH REMOVAL AND PREVENTION IN AN INTERNAL COMBUSTION ENGINE

(71) Applicant: McAlister Technologies, LLC, Phoenix, AZ (US)

(72) Inventor: Roy Edward McAlister, Phoenix, AZ (US)

(73) Assignee: McAlister Technologies, LLC, Phoenix, AZ (US)

( * ) Notice: Subject to any disclaimer, the term of this patent is extended or adjusted under 35 U.S.C. 154(b) by 0 days.

(21) Appl. No.: 13/797,800

(22) Filed: Mar. 12, 2013

(51) Int. Cl.
*B08B 3/12* (2006.01)

(52) U.S. Cl.
USPC ..... 134/1; 134/18; 134/22.1; 134/42; 123/297

(58) Field of Classification Search
USPC ..... 134/1, 18, 19, 22.1, 42; 123/297
See application file for complete search history.

(56) References Cited

U.S. PATENT DOCUMENTS

| | | | | |
|---|---|---|---|---|
| 5,515,681 | A * | 5/1996 | DeFreitas | 60/740 |
| 2008/0110872 | A1* | 5/2008 | Hale et al. | 219/270 |
| 2011/0132319 | A1* | 6/2011 | McAlister | 123/297 |

* cited by examiner

*Primary Examiner* — Saeed T Chaudhry
(74) *Attorney, Agent, or Firm* — Perkins Coie LLP

(57) ABSTRACT

Methods for removing and preventing the buildup of unwanted deposits and varnishes on combustion chamber surfaces, particularly injector-igniter components that are exposed to combustion events. A method of removing deposits from an injector-igniter comprises monitoring the current across a pair of electrodes in the injector-igniter, comparing the current with a predetermined threshold level, and performing a cleaning cycle if the current exceeds the threshold level. The cleaning cycle may comprise injecting oxidant through the injector-igniter and into the combustion chamber. The cleaning cycle may further comprise ionizing the oxidant with an electrical discharge having a first polarity and ionizing the oxidant a second time with an electrical discharge having a second polarity. In other cases the cleaning cycle comprises injecting hydrogen through the injector-igniter and into the combustion chamber. In still other cases the cleaning cycle may comprise injecting coolant onto the electrodes.

20 Claims, 4 Drawing Sheets

METHODS FOR VARNISH REMOVAL AND PREVENTION IN AN INTERNAL COMBUSTION ENGINE

BACKGROUND

Economically produced and distributed fuels typically contain constituents such as carbon, sulfur, silicon, phosphorous and other potential participants in processes by which depositions on combustion chamber surfaces begin with precursor substances and upon heating by energy received from ignition and/or combustion events the precursor substance is altered and a certain amount of bonded residue is provided that grows in subsequent combustion cycles to form varnishes and deposits that cause fouling of ignition components, valves, rings, and other components of the combustion chamber.

Long standing and difficult problems with alternative fuels such as natural gas and various landfill fuels and mixtures that may be derived from anaerobic processes such as thermal dissociation, endothermic reformation, and/or digestion of sewage, garbage, farm wastes, and forest slash include: chemical and physical property variability, fuel heating value variability, and condensates such as water including acid and other highly corrosive water along with other contaminates such as silanes or siloxane that cause engine deposits, hot spots, fouling, and acidification of lubricating oil.

These problems have compromised or defeated various past attempts to provide satisfactory power, operational control, drivability, and consistency in instances that alternative fuels have been substituted for gasoline or diesel fuel in internal combustion engines. Even in instances in which elaborate compensations are made to overcome these problems, the condensates and other contaminants have ultimately compromised or destroyed combustion chamber components including valves, valve seats, pistons, and seals along with fuel metering and/or ignition subsystems.

Accordingly, there is a need to address issues associated with these types of fuels. In particular, there is a need to prevent and/or remove varnish and deposit buildup on injection and ignition components.

BRIEF DESCRIPTION OF THE DRAWINGS

Non-limiting and non-exhaustive embodiments of the devices, systems, and methods, including the preferred embodiment, are described with reference to the following figures, wherein like reference numerals refer to like parts throughout the various views unless otherwise specified.

DETAILED DESCRIPTION

Figure 1:
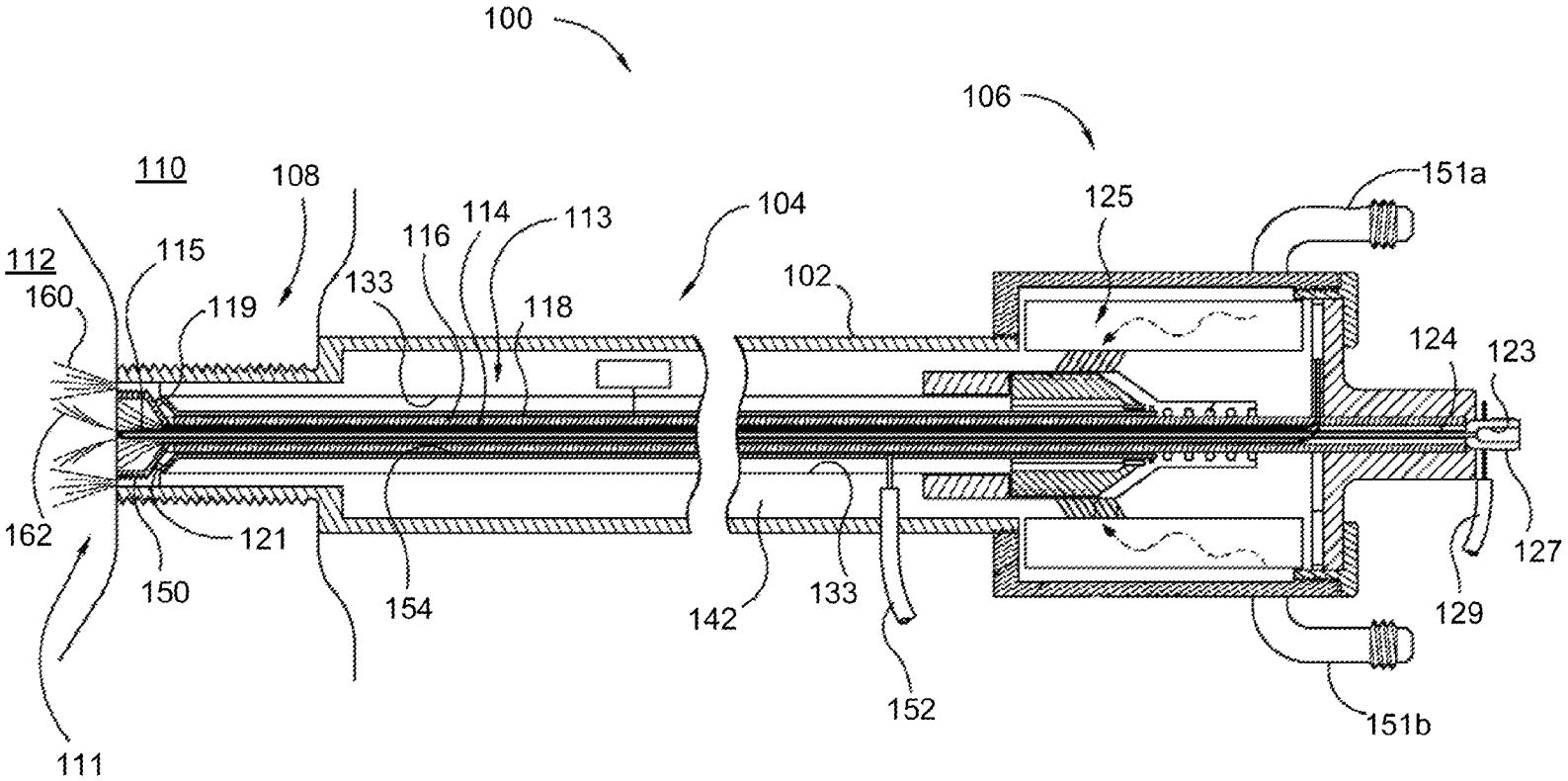
FIG. 1 is a cross-sectional side view of a representative injector-igniter, suitable for implementing the disclosed methods.

The representative embodiments disclosed herein include methods for varnish and deposit removal and prevention in an internal combustion engine. Specifically, varnish and deposit removal and prevention in injectors, ignition components, and injector-igniters. Disclosed herein are methods for removing and preventing the buildup of unwanted deposits and varnishes on combustion chamber surfaces, particularly injector-igniter components that are exposed to combustion events. In an embodiment, a method of removing deposits from an injector-igniter comprises monitoring the current across a pair of electrodes in the injector-igniter, comparing the current with a predetermined threshold level, and performing a cleaning cycle if the current exceeds the threshold level.

In certain aspects of the technology disclosed herein, the cleaning cycle comprises injecting oxidant through the injector-igniter and into the combustion chamber. The cleaning cycle may further comprise ionizing the oxidant with a first polarity and ionizing the oxidant a second time with a second polarity. In other aspects of the disclosed technology, the cleaning cycle comprises injecting hydrogen through the injector-igniter and into the combustion chamber. In some embodiments the hydrogen is ionized. In further aspects of the disclosed technology, the cleaning cycle comprises injecting coolant onto the electrodes. In some embodiments the coolant is a liquid and in other embodiments the coolant is fuel.

In another embodiment, a method of removing deposits from an injector-igniter exposed to combustion events in a combustion chamber comprises establishing a predetermined current threshold, monitoring the current across a pair of electrodes in the injector-igniter, comparing the current with the predetermined current threshold, and performing a cleaning cycle if the current exceeds the threshold level, wherein the cleaning cycle includes injecting a liquid coolant onto the electrodes. In certain aspects of the disclosed technology, the coolant is injected through a first channel of the injector-igniter. The fuel may be injected through a second channel of the injector-igniter, wherein the second channel is separate from the first channel.

In a further embodiment, a method of preventing deposits from building up on an injector-igniter exposed to combustion cycles in a combustion chamber comprises monitoring the number of combustion cycles that have occurred in the combustion chamber, comparing the number of combustion cycles with a predetermined threshold number of cycles, and performing a cleaning cycle if the number of combustion cycles exceeds the threshold number of cycles.

Specific details of several embodiments of the technology are described below with reference to FIGS. 1-8. Other details describing well-known structures and systems often associated with ignition systems, fuel systems, and electronic valve actuation, such as fuel pumps, regulators, and the like, have not been set forth in the following disclosure to avoid unnecessarily obscuring the description of the various embodiments of the technology. Many of the details, dimensions, angles, steps, and other features shown in the figures are merely illustrative of particular embodiments of the technology. Accordingly, other embodiments can have other details, dimensions, angles, steps, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1-8.

FIG. 1 is a cross-sectional side view of a representative injector-igniter 100 that is particularly suited to provide two or more fuels, coolants, or combinations of fuels and coolants. In addition, injector-igniter 100 includes ignition features capable of initiating ionization, which may then be rapidly propagated as a much larger population of ions as may be adaptively controlled by the time and position magnitude profile of applied voltage in plasma that develops and thrusts outwardly (e.g., Lorentz thrusting) from the injector-igniter 100. Accordingly, injector-igniter 100 serves as a suitable representative platform to implement the disclosed methods of preventing and removing varnish and other deposits from ignition electrodes and injector components. Other suitable injector-igniters are described in co-pending U.S. patent application Ser. No. 12/961,461 filed Dec. 6, 2010, the disclosure of which is incorporated herein by reference in its entirety. To the extent the above incorporated application and/or any other materials incorporated herein by reference conflict with the present disclosure, the present disclosure controls.

Injector-igniter 100 includes a body 102 having a middle portion 104 extending between a base portion 106 and a nozzle portion 108. The nozzle portion 108 is configured to at least partially extend through an engine head 110 to inject and ignite fuel at or near an interface 111 and/or within a combustion chamber 112. Injector-igniter 100 includes a core assembly 113 extending from the base portion 106 to the nozzle portion 108. The core assembly 113 includes an ignition conductor 114, an ignition insulator 116, and a valve 118.

The ignition conductor 114 includes an end portion 115 proximate to the interface 111 of combustion chamber 112 that includes one or more ignition features that are configured to generate an ignition event. The ignition conductor 114 also includes a first flow channel 124 extending longitudinally through a central portion of the ignition conductor 114. The ignition conductor 114 is coupled to a first terminal 127 that supplies ignition energy (e.g., voltage), as well as a first fuel or first coolant, to channel 124 to produce distribution pattern 162. The ignition conductor 114 therefore dispenses the first fuel or coolant into the combustion chamber 112 via the first flow channel 124. The first terminal 127 is also coupled to a first ignition energy source via a first ignition source conductor 129.

Injector 100 also includes a second flow channel 133 extending longitudinally through the body 102 from the fuel inlet passages 151 (identified individually as a and 151*b*) located on base portion 106 to the nozzle portion 108. More specifically, the second flow channel 133 extends coaxially with the stem portion of the valve 118 and is spaced radially apart from the stem portion of the valve 118. A second fuel or coolant can enter the second flow channel 133 from the base portion 106 of the injector 100 to pass to the combustion chamber 112 via valve 118. The valve 118 includes a first end portion in the base portion 106 that engages an actuator or valve operator assembly 125. The valve 118 also includes a sealing end portion 119 that contacts a valve seal 121. The valve operator assembly 125 actuates the valve 118 relative to the ignition insulator 116 between an open position and a closed position. In the open position, the sealing end portion 119 of the valve 118 is spaced apart from the valve seal 121 to allow the second fuel or coolant to flow past the valve seal 121 and out of the nozzle portion 108 to produce distribution pattern 160.

The injector 100 further includes an insulated second terminal 152 at the middle portion 104 or at the base portion 106. The second terminal 152 is electrically coupled to the second ignition feature 150 via a second ignition conductor 154. For example, the second ignition conductor 154 can be a conductive layer or coating disposed on the ignition insulator 116. The second ignition feature 150 is coaxial and radially spaced apart from the end portion 115 of the ignition conductor 114.

In operation, the injector-igniter 100 is configured to inject one, two or more fuels, coolants, and/or combinations of fuels and coolants into the combustion chamber 112. The injector 100 is also configured to ignite the fuels as the fuels exit the nozzle portion 108, and/or provide projected ignition within the combustion chamber. For example, a first fuel or coolant can be introduced into the first flow passage 124 in the ignition conductor 116 via the first inlet passage 123 in the first terminal 127. A second fuel or coolant can be introduced into the base portion 106 via the second inlet passage 151. The second fuel or coolant can travel from the second inlet passage 151 through the second flow channel 133 extending longitudinally adjacent to the valve 118. The second flow channel 133 extends between an outer surface of the valve 118 and an inner surface of the body insulator 142 of the middle portion 104 and the nozzle portion 108.

The first ignition source conductor 129 can energize or otherwise transmit ignition energy (e.g., voltage) to an ignition feature carried by the ignition conductor 116 at the nozzle portion 108. As such, the ignition conductor 116 can ionize and/or ignite oxidant supplied by operation of the combustion chamber and the first fuel at the interface 111 with the combustion chamber 112. The second ignition conductor 150 conveys DC and/or AC voltage to adequately heat and/or ionize and rapidly propagate and thrust the fuel toward the combustion chamber. A second terminal 152 can provide the ignition energy to the second ignition feature 150 via the second ignition conductor 154.

With respect to the first ignition features at the end portion 115 of the ignition conductor 114, as well as the second ignition feature 150, each ignition feature can develop plasma discharge blasts of ionized oxidant and/or fuel that is rapidly accelerated and injected into the combustion chamber 112. Generating such high voltage at the ignition features initiates ionization, which is then rapidly propagated as a much larger population of ions in plasma that develops and travels outwardly. This is sometimes referred to as Lorentz thrusting, examples of which are described in U.S. Pat. No. 4,122,816, issued Oct. 31, 1978, the disclosure of which is incorporated herein by reference in its entirety.

Figure 2:
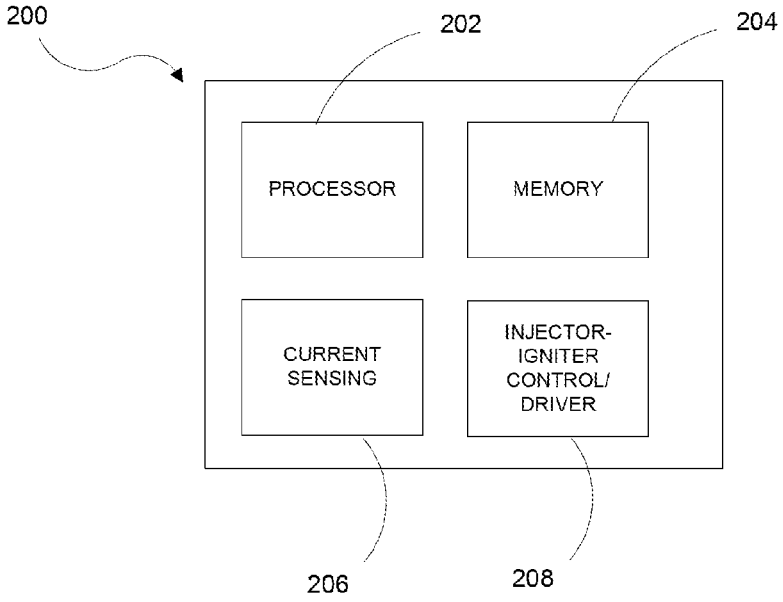
FIG. 2 is a schematic representation of an injector-igniter controller according to a representative embodiment.

Some aspects of the technology described below may take the form of or make use of computer-executable instructions, including routines executed by a programmable computer or controller 200, such as shown in FIG. 2. Controller 200 includes a processor 202 and a memory 204. In this embodiment, controller 200 also includes current sensing circuitry 206 and injector driver circuitry and ignition control circuitry 208. Current sensing, injector driver circuitry, and ignition control circuitry are all well known in the art. Those skilled in the relevant art will appreciate that aspects of the technology can be practiced on computer systems other than those described herein. Aspects of the technology can be embodied in a special-purpose computer or data processor, such as an engine control unit (ECU), engine control module (ECM), fuel system controller, ignition controller, or the like, that is specifically programmed, configured, or constructed to perform one or more computer-executable instructions consistent with the technology described below. Accordingly, the term "computer," "processor," or "controller," as may be used herein, refers to any data processor and can include ECUs, ECMs, and modules, as well as Internet appliances and hand-held devices (including diagnostic devices, palm-top computers, wearable computers, cellular or mobile phones, multi-processor systems, processor-based or programmable consumer electronics, network computers, mini computers, and the like). Information handled by these computers can be presented on any suitable display medium, including a CRT display, LCD, or dedicated display device or mechanism (e.g., gauge).

The technology can also be practiced in distributed environments, where tasks or modules are performed by remote processing devices that are linked through a communications network. In a distributed computing environment, program modules or subroutines may be located in local and remote memory storage devices. Aspects of the technology described below may be stored or distributed on computer-readable media, including magnetic or optically readable or removable computer disks, as well as distributed electronically over networks. Such networks may include, for example and without limitation, Controller Area Networks (CAN), Local Interconnect Networks (LIN), and the like. In particular embodiments, data structures and transmissions of data particular to aspects of the technology are also encompassed within the scope of the technology.

Referring again to FIG. 1, it can be appreciated that in operation the electrodes (e.g., 114, 115, and 150) may become fouled by varnish and/or deposits (collectively "deposits"). In some cases, deposits may build up to the extent that they bridge across the electrodes. Both varnish and deposits hinder the operation of the ignition devices by increasing or decreasing their effective resistance and consequently the voltage and energy conversion efficiency necessary for proper operation. In order to help prevent and/or remove these deposits, representative cleaning cycle methods and strategies are described herein.

Figure 3:
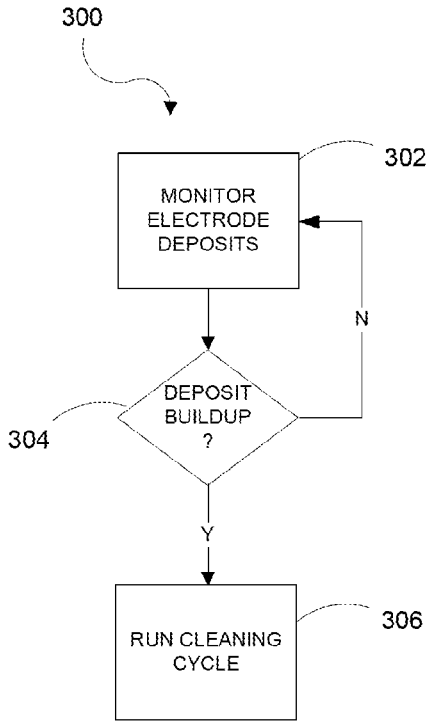
FIG. 3 is a flowchart illustrating a method of removing deposits in a combustion engine according to a representative embodiment.
Figure 4:
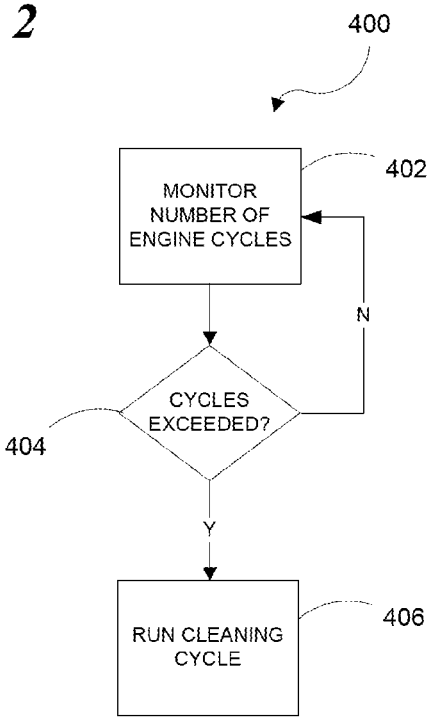
FIG. 4 is a flowchart illustrating a method of preventing deposits in a combustion engine according to a representative embodiment.

FIG. 3 illustrates a method of removing deposits according to a representative embodiment. Generally, the method of removing deposits 300 includes monitoring electrodes, such as electrodes 114, 115, and 150, at step 302 and determining at step 304 if deposits or varnish have built up to a level that warrants a cleaning cycle be performed at step 306. If the deposit buildup has not reached a selected level, the method continues to monitor the electrodes at 302. FIG. 4 illustrates a representative method for preventing deposit buildup. Generally, the method of preventing deposits 400 includes monitoring the number of engine cycles at step 402 in order to determine at step 404 if a selected number of engine cycles has been exceeded. If the selected number of engine cycles has been exceeded at step 404, a cleaning cycle is performed at step 406. Otherwise the method continues to monitor the current number of engine cycles. In the deposit removal method 300, the cleaning cycle is performed once an actual deposit is detected. However, in the prevention method 400, the cleaning cycle is performed periodically regardless of whether a deposit is detected. In prevention method 400, the selected number of cycles is chosen based on the number of combustion cycles that are expected to begin generating varnish and/or deposits.

Figure 5:
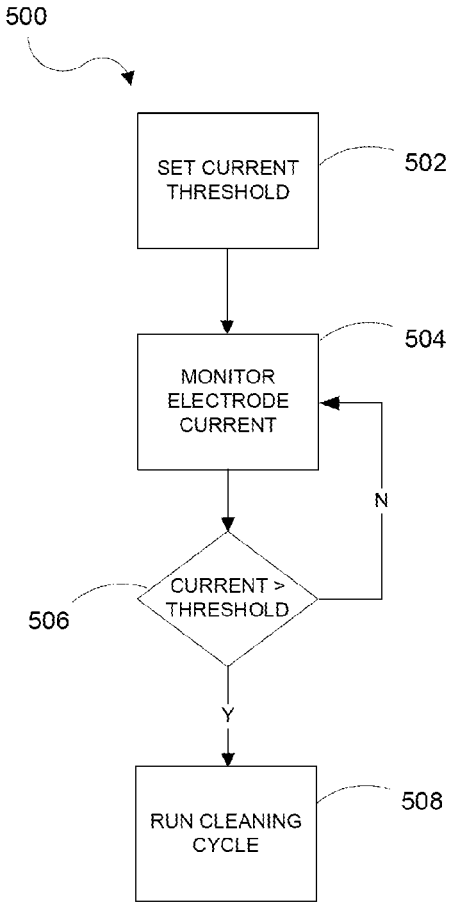
FIG. 5 is a flowchart illustrating a method of removing deposits in a combustion engine according to another representative embodiment.

FIG. 5 illustrates a method for removing deposits 500, according to another representative embodiment. In this embodiment, a predetermined current threshold is set at step 502 and may be stored in memory 204 (FIG. 2), for example. The current required to initiate ignition at the igniter electrodes, such as 114, 115, and 150, are monitored at step 504 with a suitable current sensing circuit, such as current sensing circuit 206 (FIG. 2). Once the current exceeds the predetermined threshold at decision block 506 a cleaning cycle is performed at step 508. Otherwise, the electrode current is monitored at 504. While this embodiment determines if deposits have built up on the electrodes by using current sensing, other suitable methods of detecting deposit buildup may be used including sensing the presence of deposits by optical sensors and/or by temperature or capacitance sensors. Moreover, although the prevention cleaning cycle (method 400) is performed based on the number of combustion events or cycles, other criteria for performing a preventative cleaning cycle may be used. For example and without limitation, elapsed time, load, engine speed, and combinations thereof.

Figure 6:
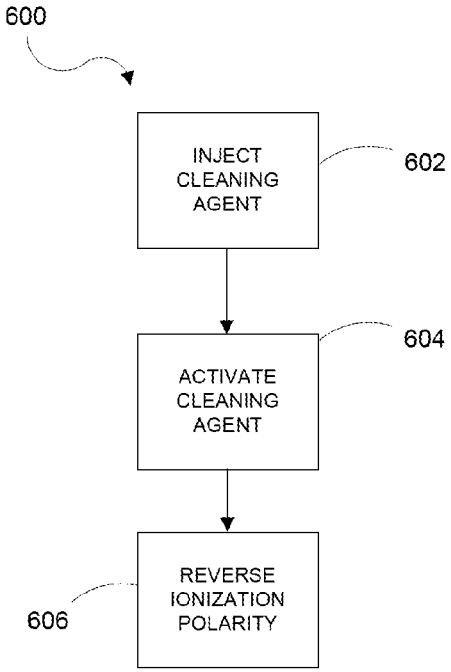
FIG. 6 is a flowchart illustrating a cleaning cycle according to a representative embodiment.

FIG. 6 illustrates a cleaning cycle method 600 according to a representative embodiment. In this embodiment, a cleaning agent in the form of hydrogen, hydrogen ions, or a hydrogen donor such as $NH_3$ or an oxidant(s) such as air, O, $O_2$, $O_3$, OH, $N_2O$, NO, or $NO_2$ is injected at step 602 through an injector-igniter, such as injector-igniter 100, and into the combustion chamber. For example, the oxidant(s) may be injected through the first flow channel 124 and/or the second flow channel 133. The injected cleaning agent (e.g., oxidant) is activated by ionization at step 604 using the plasma thrusting capabilities of the injector-igniter as described above. Ionizing the oxidant activates the oxidant such that it removes varnishes and deposits left behind from combustion events. It is particularly advantageous to operate cleaning cycle 600 for electrodes, orifices, and/or other critical combustion chamber surfaces during the intake or compression events of engine operation. In some implementations, oxidants that enter the spaces between the electrodes can be used in one or more cleaning cycles by ionizing and thrusting the bursts of highly activated oxidant along the electrode surfaces, orifices, passageways, and other critical combustion chamber surfaces to remove or eliminate deposits and particles. In some embodiments, the method may include a second ionization of the oxidants, but with a reverse polarity, in order to decelerate and/or reciprocate the ion thrust. Therefore, the activated oxidant is available at the electrodes for removing the deposits.

Figure 7:
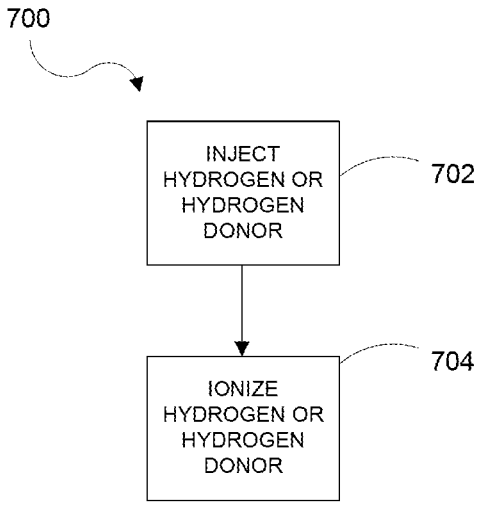
FIG. 7 is a flowchart illustrating a cleaning cycle according to another representative embodiment.

FIG. 7 illustrates a cleaning cycle method 700 according to a representative embodiment. In this embodiment, hydrogen and/or a hydrogen donor such as ammonia is injected at or after top dead center (TDC) at step 702. The hydrogen and/or hydrogen donor can be injected by one or more valve openings via the first or second flow channels 124, 133, with or without Lorentz thrusting. In an embodiment, the injected hydrogen and/or hydrogen donor is ionized at step 704 using the plasma thrusting capabilities of the injector-igniter 100. Such hydrogen and/or hydrogen donor and/or hydrogen ions may be injected through valve 118, and around electrodes 114, 115, and 150, to help prevent and/or clean away any deposits. The nascent and/or ionized nitrogen and/or hydrogen reduces or eliminates the nucleation sites for varnish formation.

Equations 1, 2, and 3 illustrate representative degrees of activation and/or ionization for a typical hydrogen donor such as ammonia.

$$NH_3 \rightarrow N + 1.5H_2 \qquad \text{Equation 1}$$

$$NH_3 \rightarrow N^- + H + H + H^+ \qquad \text{Equation 2}$$

$$NH_3 \rightarrow N^- + H^+ + H + H^+ \qquad \text{Equation 2}$$

Figure 8:
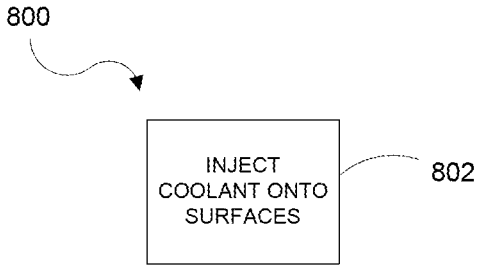
FIG. 8 is a flowchart illustrating a cleaning cycle according to a still further representative embodiment.

FIG. 8 illustrates a cleaning cycle method 800 according to a representative embodiment. In this embodiment, the combustion chamber surfaces, including electrode surfaces 114, 115, and 150, are rapidly cooled and/or scrubbed and/or chemically cleaned by the introduction of coolant ingredients at step 802. The coolant removes deposits by surface active agents and/or thermal shock due to thermal expansion and/or contraction stresses that cause release and/or removal of the deposits. In an embodiment, the coolant comprises fuel. In such an embodiment, fuel may not be injected or the fuel is not ignited and/or may be injected in a quantity that is less than that normally injected during a combustion cycle. Such fuel may be introduced for cleaning purposes, carrying cleaning agents, and/or for increasing the power production from a turbo charger that serves the host engine. The coolant may be injected through the first flow channel 124 and/or the second flow channel 133 as explained above with respect to FIG. 1.

From the foregoing it will be appreciated that, although specific embodiments of the technology have been described herein for purposes of illustration, various modifications may be made without deviating from the spirit and scope of the technology. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. The following examples provide additional embodiments of the present technology.

EXAMPLES

1. A method of removing deposits from an injector-igniter exposed to combustion events in a combustion chamber, the method comprising:

monitoring the current across a pair of electrodes in the injector-igniter;

comparing the current with a predetermined threshold level; and performing a cleaning cycle if the current exceeds the threshold level.

2. The method of example 1, wherein the cleaning cycle comprises injecting oxidant through the injector-igniter and into the combustion chamber.

3. The method of example 2, wherein the cleaning cycle further comprises ionizing the oxidant with an electrical discharge having a first polarity.

4. The method of example 3, wherein the cleaning cycle further comprises ionizing the oxidant a second time with an electrical discharge having a second polarity.

5. The method of example 1, wherein the cleaning cycle comprises injecting hydrogen through the injector-igniter and into the combustion chamber.

6. The method of example 5, wherein the cleaning cycle further comprises ionizing the hydrogen.

7. The method of example 1, wherein the cleaning cycle comprises injecting coolant onto the electrodes.

8. The method of example 7, wherein the coolant is liquid.

9. The method of example 7, wherein the coolant is fuel.

10. A method of removing deposits from an injector-igniter exposed to combustion events in a combustion chamber, the method comprising:

establishing a predetermined current threshold;

monitoring the current across a pair of electrodes in the injector-igniter;

comparing the current with the predetermined current threshold; and performing a cleaning cycle if the current exceeds the threshold level, wherein the cleaning cycle includes injecting a liquid coolant onto the electrodes.

11. The method of example 10, wherein the coolant is injected through a first channel of the injector-igniter.

12. The method of example 11 wherein a fuel is injected through a second channel of the injector-igniter, wherein the second channel is separate from the first channel.

13. The method of example 10, wherein the coolant is fuel.

14. A method of preventing deposits from building up on an injector-igniter exposed to combustion cycles in a combustion chamber, the method comprising:

monitoring the number of combustion cycles that have occurred in the combustion chamber;

comparing the number of combustion cycles with a predetermined threshold number of cycles; and performing a cleaning cycle if the number of combustion cycles exceeds the threshold number of cycles.

15. The method of example 14, wherein the cleaning cycle comprises injecting oxidant through the injector-igniter and into the combustion chamber.

16. The method of example 15, wherein the cleaning cycle further comprises ionizing the oxidant with an electrical discharge having a first polarity.

17. The method of example 16, wherein the cleaning cycle further comprises ionizing the oxidant a second time with an electrical discharge having a second polarity.

18. The method of example 14, wherein the cleaning cycle comprises injecting hydrogen through the injector-igniter and into the combustion chamber.

19. The method of example 18, wherein the cleaning cycle further comprises ionizing the hydrogen.

20. The method of example 14, wherein the cleaning cycle comprises injecting coolant onto the electrodes.

I claim:

1. A method of removing deposits from an injector-igniter exposed to combustion events in a combustion chamber, the method comprising:

monitoring the current across a pair of electrodes in the injector-igniter;

comparing the current with a predetermined threshold level; and performing a cleaning cycle if the current exceeds the threshold level.

2. The method of claim 1, wherein the cleaning cycle comprises injecting oxidant through the injector-igniter and into the combustion chamber.

3. The method of claim 2, wherein the cleaning cycle further comprises ionizing the oxidant with an electrical discharge having a first polarity.

4. The method of claim 3, wherein the cleaning cycle further comprises ionizing the oxidant a second time with an electrical discharge having a second polarity.

5. The method of claim 1, wherein the cleaning cycle comprises injecting hydrogen through the injector-igniter and into the combustion chamber.

6. The method of claim 5, wherein the cleaning cycle further comprises ionizing the hydrogen.

7. The method of claim 1, wherein the cleaning cycle comprises injecting coolant onto the electrodes.

8. The method of claim 7, wherein the coolant is liquid.

9. The method of claim 7, wherein the coolant is fuel.

10. A method of removing deposits from an injector-igniter exposed to combustion events in a combustion chamber, the method comprising:

establishing a predetermined current threshold;

monitoring the current across a pair of electrodes in the injector-igniter;

comparing the current with the predetermined current threshold; and performing a cleaning cycle if the current exceeds the threshold level, wherein the cleaning cycle includes injecting a liquid coolant onto the electrodes.

11. The method of claim 10, wherein the coolant is injected through a first channel of the injector-igniter.

12. The method of claim 11 wherein a fuel is injected through a second channel of the injector-igniter, wherein the second channel is separate from the first channel.

13. The method of claim 10, wherein the coolant is fuel.

14. A method of preventing deposits from building up on an injector-igniter exposed to combustion cycles in a combustion chamber, the method comprising:

monitoring the number of combustion cycles that have occurred in the combustion chamber;

comparing the number of combustion cycles with a predetermined threshold number of cycles; and performing a cleaning cycle if the number of combustion cycles exceeds the threshold number of cycles.

15. The method of claim 14, wherein the cleaning cycle comprises injecting oxidant through the injector-igniter and into the combustion chamber.

16. The method of claim 15, wherein the cleaning cycle further comprises ionizing the oxidant with an electrical discharge having a first polarity.

17. The method of claim 16, wherein the cleaning cycle further comprises ionizing the oxidant a second time with an electrical discharge having a second polarity.

18. The method of claim 14, wherein the cleaning cycle comprises injecting hydrogen through the injector-igniter and into the combustion chamber.

19. The method of claim 18, wherein the cleaning cycle further comprises ionizing the hydrogen.

20. The method of claim 14, wherein the cleaning cycle comprises injecting coolant onto the electrodes.

* * * * *